US005890710A

United States Patent [19]

Phillips et al.

[11] Patent Number: 5,890,710

[45] Date of Patent: Apr. 6, 1999

[54] DOCUMENT FEEDER APPARATUS

[75] Inventors: Robert W. Phillips, Waterloo; Kenneth S. Seymour, Conestogo, both of Canada

[73] Assignee: NCR Corporation, Dayton, Ohio

[21] Appl. No.: 837,259

[22] Filed: Apr. 10, 1997

[51] Int. Cl.[6] ..... B65H 3/52

[52] U.S. Cl. ..... 271/124

[58] Field of Search ..... 271/10.06, 10.08, 271/34, 35, 121, 124, 122

[56] References Cited

U.S. PATENT DOCUMENTS

| | | | |
|---|---|---|---|
| 3,709,482 | 1/1973 | Nelson et al. | 271/34 X |
| 3,734,490 | 5/1973 | Parks . | |
| 3,934,869 | 1/1976 | Strobel, Jr. . | |
| 4,556,209 | 12/1985 | Tsubo . | |
| 5,033,729 | 7/1991 | Struthers . | |
| 5,730,439 | 3/1998 | Salomon | 271/121 X |

*Primary Examiner*—David H. Bollinger
*Attorney, Agent, or Firm*—Michael Chan

[57] ABSTRACT

A document feeder apparatus is provided for feeding documents along a document feed path. The document feeder apparatus comprises a picker mechanism for picking a number of documents from a stack of documents stored in a hopper and moving the picked documents along the document feed path. An advance mechanism includes an advance roller having a longitudinal central axis and being rotatable about its longitudinal axis. The advance roller has an outer circumferential surface which is engageable with one side of the picked document moving along the document feed path. A retard mechanism includes an endless retard belt having an outer major side surface which is engageable with the opposite side of the picked document moving along the document path. The outer major side surface of the endless retard belt and the outer circumferential surface of the advance roller cooperate to define at least a portion of the document feed path therebetween. Tension is applied to the endless retard belt such that a relatively constant pinch pressure is applied to the picked document while the picked document is moving along that portion of the document feed path between the outer major side surface of the endless retard belt and the outer circumferential surface of the advance roller.

5 Claims, 5 Drawing Sheets

DOCUMENT FEEDER APPARATUS

BACKGROUND OF THE INVENTION

The present invention relates to document feeding along a document feed path, and is particularly directed to a document feeder for feeding a document along a document feed path in a document processing system such as a bank check processing system.

Many different types of document feeder apparatus are known. Some known document feeder apparatus include an advance/retard mechanism which is typically either a pair of belts which are spring loaded against each other or a pair of rollers which are spring loaded against each other. During proper operation of the advance/retard mechanism, misfeeding of documents and damage to documents being fed are avoided. Due to normal wear and tear, the contact surfaces of the pair of belts or the contact surfaces of the pair of rollers become contaminated. The advance/retard mechanism may not operate properly when the contact surfaces of the belts or the contact surfaces of the rollers become contaminated. When the advance/retard mechanism is not operating properly, a fault condition such as a double document feed condition may result.

SUMMARY OF THE INVENTION

In accordance with one aspect of the present invention, a document feeder apparatus is provided for feeding documents along a document feed path. The document feeder apparatus comprises a picker mechanism for picking a number of documents from a stack of documents stored in a hopper and moving the picked documents along the document feed path. An advance mechanism includes an advance roller having a longitudinal central axis and being rotatable about its longitudinal axis. The advance roller has an outer circumferential surface which is engageable with one side of the picked document moving along the document feed path. A retard mechanism includes an endless retard belt having an outer major side surface which is engageable with the opposite side of the picked document moving along the document path. The outer major side surface of the endless retard belt and the outer circumferential surface of the advance roller cooperate to define at least a portion of the document feed path therebetween. Tension means is provided for applying tension force to the endless retard belt such that a relatively constant pinch pressure is applied to the picked document while the picked document is moving along that portion of the document feed path between the outer major side surface of the endless retard belt and the outer circumferential surface of the advance roller.

Preferably, the retard mechanism includes a body having a weight which is applied to the retard belt to maintain a relatively constant tension in the retard belt as documents are being fed along the document feed path. The picker mechanism includes a picker roller and an endless picker belt disposed around at least a portion of the picker roller. The picker belt has an outer surface which engages the documents in the stack of documents as the picker belt moves relative to the documents. The tension means includes a body movable between different positions and is provided for, when moved between different positions, providing a variable tension which acts on the retard belt. The body includes a longitudinally extending member having a first end portion which is pivotably connected to a frame part of the document processing system and a second end portion operatively coupled to the retard belt to apply tension to the retard belt. The tension means includes coupling means for coupling the body to the retard belt to allow the body to apply the variable tension to the retard belt as the body moves between different positions. The coupling means includes (ii) a movable roller on which the retard belt is disposed and (ii) a cable having one end connected to the second end portion of the longitudinally extending member and the other end connected to the movable roller on which the retard belt is disposed.

In accordance with another aspect of the present invention, a document feeder apparatus is provided for feeding documents along a document feed path. The document feeder apparatus comprises a picker mechanism for picking a number of documents from a stack of documents stored in a hopper and moving the picked documents along the document feed path. An advance mechanism includes an advance roller having a longitudinal central axis and being rotatable about its longitudinal axis. The advance roller has an outer circumferential surface which is engageable with one side of the picked document moving along the document feed path. A retard mechanism includes an endless retard belt having an outer major side surface which is engageable with the opposite side of the picked document moving along the document path. The outer major side surface of the endless retard belt and the outer circumferential surface of the advance roller cooperate to define at least a portion of the document feed path therebetween. Belt tension release means is provided for enabling the endless retard belt in that portion of the document feed path between the outer major side surface of the endless retard belt and the outer circumferential surface of the advance roller to be pivoted away from the advance roller and thereby to allow a jammed document to be more easily removed therefrom.

Preferably, the retard mechanism includes a body having a weight which is applied to the retard belt to maintain a relatively constant tension in the retard belt as documents are being fed along the document feed path. The picker mechanism includes a picker roller and an endless picker belt disposed around at least a portion of the picker roller. The picker belt has an outer surface which engages the documents in the stack of documents as the picker belt moves relative to the documents. The belt tension release means includes a rotatable belt tension release knob which, when rotated in a predetermined direction, moves the endless retard belt in that portion of the document feed path between the outer major side surface of the endless retard belt and the outer circumferential surface of the advance roller away from the advance roller body.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILS OF THE INVENTION

Figure 1:
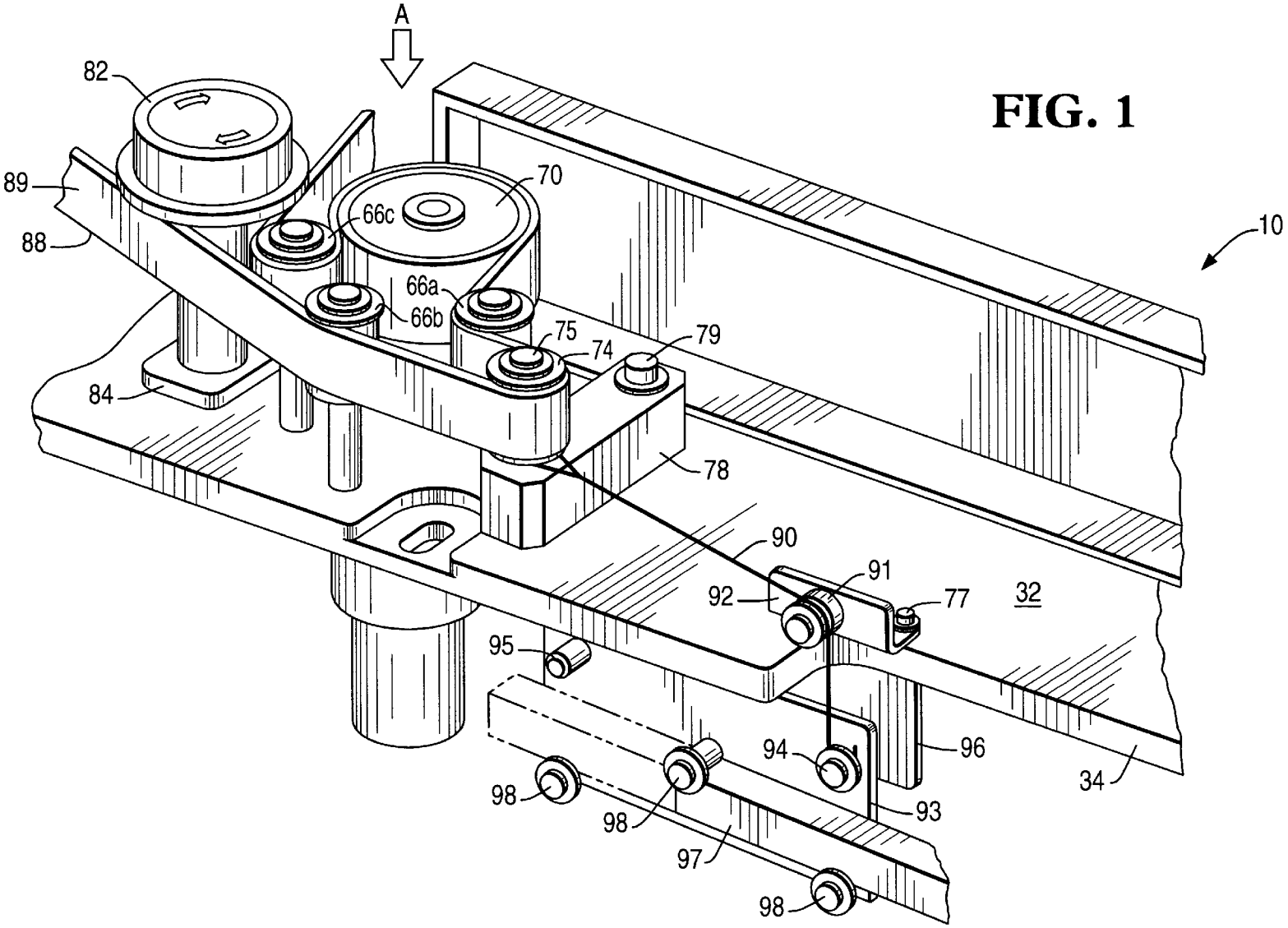
FIG. 1 is a perspective view of a document processing system embodying an apparatus constructed in accordance with the present invention.
Figure 2:
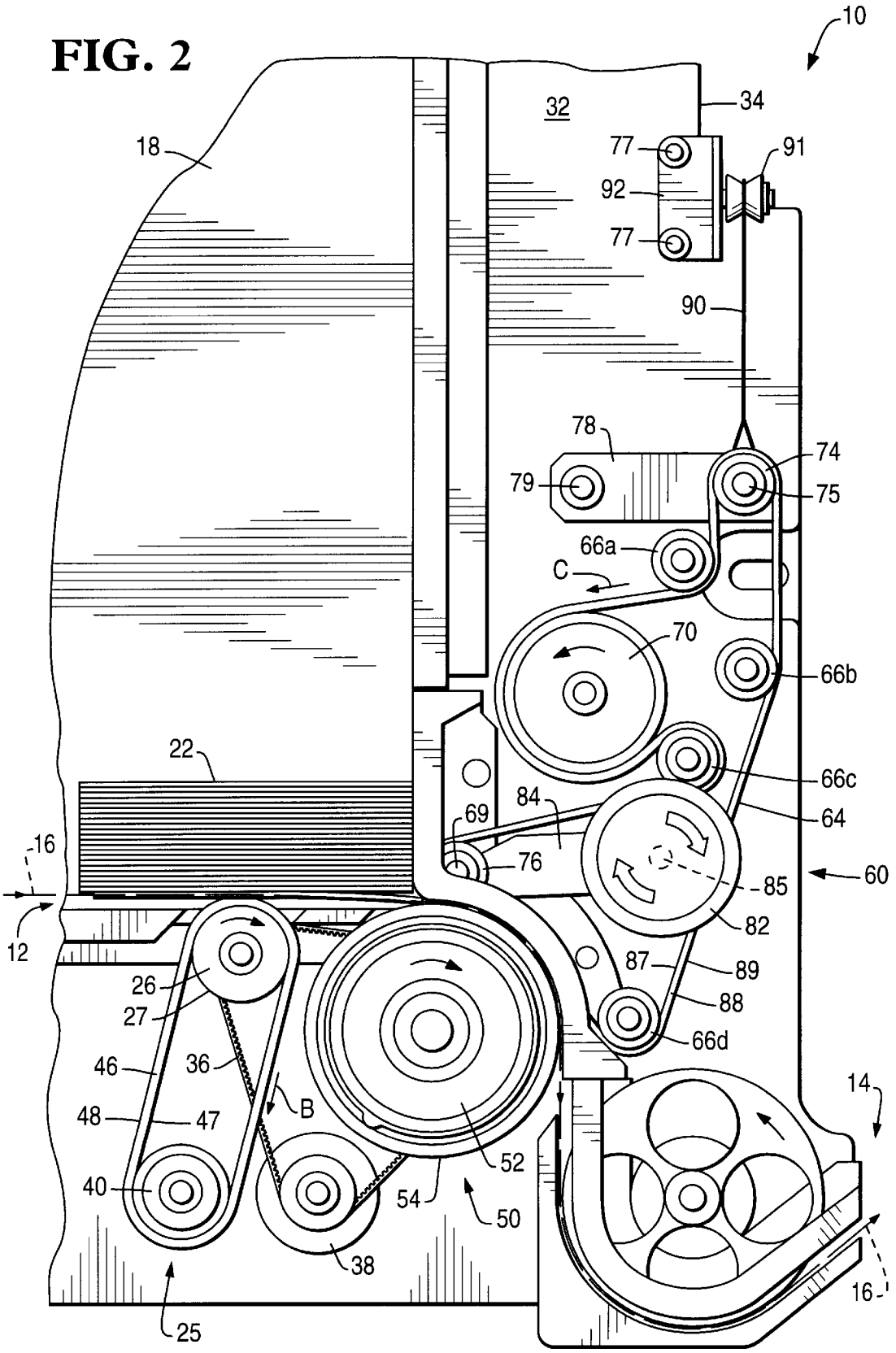
FIG. 2 is a view looking in the direction of arrow A in FIG. 1.

The present invention is directed to a document feeder apparatus which feeds documents one-by-one from a stack of documents along a document feed path. The specific use and construction of the present invention may vary. By way of example as shown in FIGS. 1 and 2, a document feeder apparatus constructed in accordance with the present invention is embodied in a document processing system 10 such as a check processing system.

The document processing system 10 has an upstream end 12, a downstream end 14, and a document feed path 16 (shown in dashed lines in FIG. 2) defined between the upstream end 12 and the downstream end 14. A hopper 18 (FIG. 2) containing a stack 22 of documents is located along and above the document feeding path 16.

A picker mechanism 25 includes a picker roller 26 having an outer circumferential surface 27. The picker roller 26 is fixedly attached to a toothed wheel (not shown) located beneath the picker roller 26. When the toothed wheel rotates about its longitudinal central axis, the picker roller 26 rotates about its longitudinal central axis. An endless drive belt 46 extends around the picker roller 26 and an idler wheel 40, as shown in FIG. 2. The belt 46 has an inner major side surface 47 and an outer major side surface 48. When the picker roller 26 is driven to rotate about its longitudinal central axis in the direction of the arrow shown in the picker roller 26 in FIG. 2, the belt 46 is driven to move in the direction of arrow "B" shown in FIG. 2. While the belt 46 is being driven, the outer major side surface 48 engages a document from the stack 22 of documents stored in the hopper 12 and moves the engaged document along the document feed path 16.

An advance mechanism 50 includes an advance roller 52 having an outer circumferential surface 54. The advance roller 52 is fixedly attached to a toothed wheel (not shown) located beneath the advance roller 52. The outer circumferential surface 54 of the advance roller 52 has a relatively high coefficient of friction. A toothed timing belt 36 is operatively coupled in a known manner to a drive roller 38, the toothed wheel beneath the advance roller 52, and the toothed wheel beneath the picker roller 26. The drive roller 38 is drivingly connected to a drive motor (not shown) which operates to rotate the drive roller 38 about its longitudinal central axis. When the drive roller 38 rotates about its longitudinal central axis, the picker roller 26 rotates about its longitudinal central axis in the direction of the arrow in the picker roller 26 in FIG. 1 and the advance roller 52 rotates about its longitudinal central axis in the direction of the arrow in the advance roller 52 in FIG. 1.

A retard mechanism 60 includes an endless retard belt 88 having an endless outer major side surface 64. Four stationary guide rollers, individually designated with reference numerals 66*a*, 66*b*, 66*c*, 66*d*, are rotatably mounted on respective pivot posts which, in turn, are fixedly attached to a mounting surface 32 of a base plate 34. The guide rollers 66*a*, 66*b*, 66*c*, 66*d*, are collectively referred to as "guide rollers 66".

Figure 5:
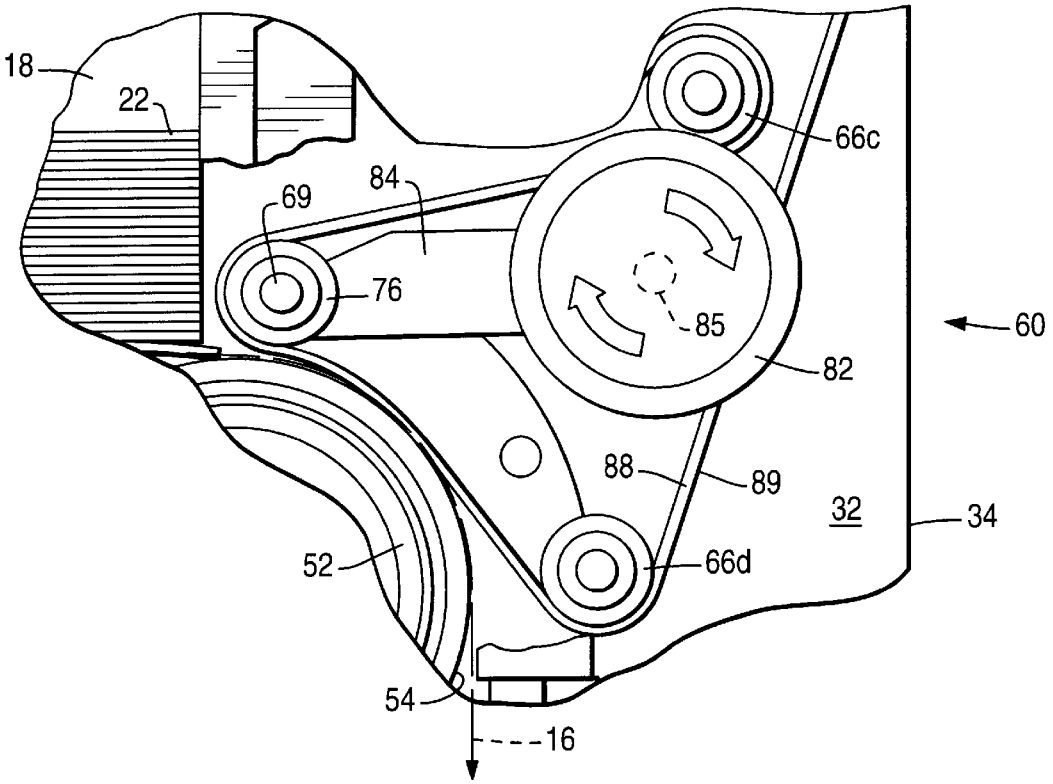
FIG. 5 is an enlarged view of a portion of FIG. 2 with some parts broken away to illustrate certain details.
Figure 6:
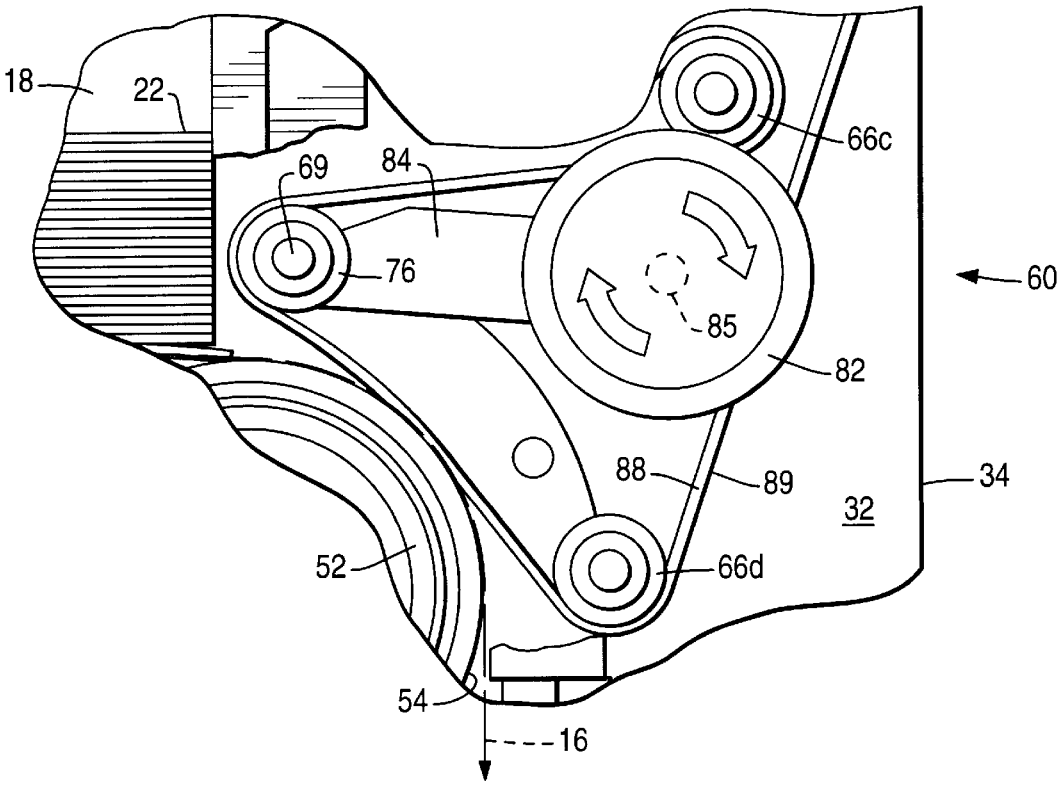
FIG. 6 is a view similar to FIG. 5 and showing parts in different positions.

A retard belt drive roller 70 is drivingly connected to a motor driven gear box shaft (not shown). A first movable roller 74 is rotatably mounted on a first pivot post 75 which, in turn, is fixedly attached to one end of a pivot arm 78. The other end of the first pivot arm 78 is pivotably mounted on a pivot post 79 which, in turn, is fixedly attached to the mounting surface 32 of the base plate 34. One end of a second pivot arm 84 is pivotably mounted on a pivot post 85 which, in turn, is fixedly attached to the mounting surface 32 of the base plate 34. A second movable roller 76 is rotatably mounted on a second pivot post 69 which, in turn, is fixedly mounted on the other end of the second pivot arm 84. A belt tension release knob 82 is attached to the one end of the second pivot arm 84 such that the pivot arm can be moved from a position shown in FIG. 5 to a position such as shown in FIG. 6 when the release knob 82 is manually rotated clockwise (as viewed in FIGS. 5 and 6).

The endless retard belt 88 extends around the guide rollers 66, the retard belt drive roller 70, the first movable roller 74, and the second movable roller 76. The belt 88 has an inner endless major side surface 87 and an outer endless major side surface 89. The outer endless major side surface 89 of the retard belt 88 and the outer circumferential surface 54 of the advance roller 52 cooperate to define at least a portion of the document feeding path 16 defined between the upstream end 12 and the downstream end 14, as best shown in FIGS. 5 and 6. More specifically, the belt 88 is deformed along an arcuate area of contact on the outer circumferential surface 54 of the advance roller 52. This area of contact between the outer circumferential surface 54 of the advance roller 52 and the outer endless major side surface 89 of the belt 88 forms that portion of the document feeding path 16 defined between the upstream end 12 and the downstream end 14.

As best illustrated in FIG. 1, one end of a wire cable 90 is attached to the first movable roller 74. The wire cable 90 is routed around a pulley 91 which is connected to a bracket 92 which, in turn, is fixedly attached to the mounting surface 32 of the base plate 34 using fastener 77. The other end of the cable 90 is connected to a bracket 93 using a fastener 94. The bracket 93 is pivotably mounted on a pivot post 95 which is fixedly attached to another bracket 96 which, in turn, is fixedly attached to the base plate 34 using suitable fasteners (not shown). One end of a longitudinally extending member 97 is fixedly attached to the bracket 93 using fasteners 98.

When the retard belt drive roller 70 is driven to rotate about its longitudinal central axis in the direction of the arrow shown in the retard belt drive roller 70 in FIG. 2, the retard belt 88 is driven to move in the direction of arrow "C" shown in FIG. 2. While the retard belt 88 is being driven, the outer major side surface 89 of the retard belt 88 engages a document moving along that portion of the document feed path 16 defined between the advance roller 52 and the retard belt 88.

When a document is about to be picked from the bottom of the stack 22 of documents in the hopper 12, as shown in FIG. 2, the picker roller 26 is rotating in the direction of the arrow shown in the picker roller 26 and the advance roller 52 is rotating in the direction of the arrow shown in the advance roller of FIG. 2. The picker belt 46 is driven to move in the direction of arrow B shown in FIG. 1. At the same time, the retard belt drive roller 70 is driven to rotate in the direction of the arrow shown in the retard belt drive roller of FIG. 2. The retard belt 88 is driven to move in the direction of arrow C shown in FIG. 2. The advance roller 52 and the retard belt 88 are driven such that the outer circumferential surface 54 of the advance roller 52 in the vicinity of the document feed path 16 is moving at a speed slightly higher than the speed at which the outer endless major side surface 89 of the retard belt 88 in the vicinity of the document feed path 16 is moving. Belt pressure (pinch pressure) is developed in that portion of the document feed path 16 between the outer circumferential surface 54 of the advance roller 52 and the outer endless major side surface 89 of the retard belt 88.

Figure 3:
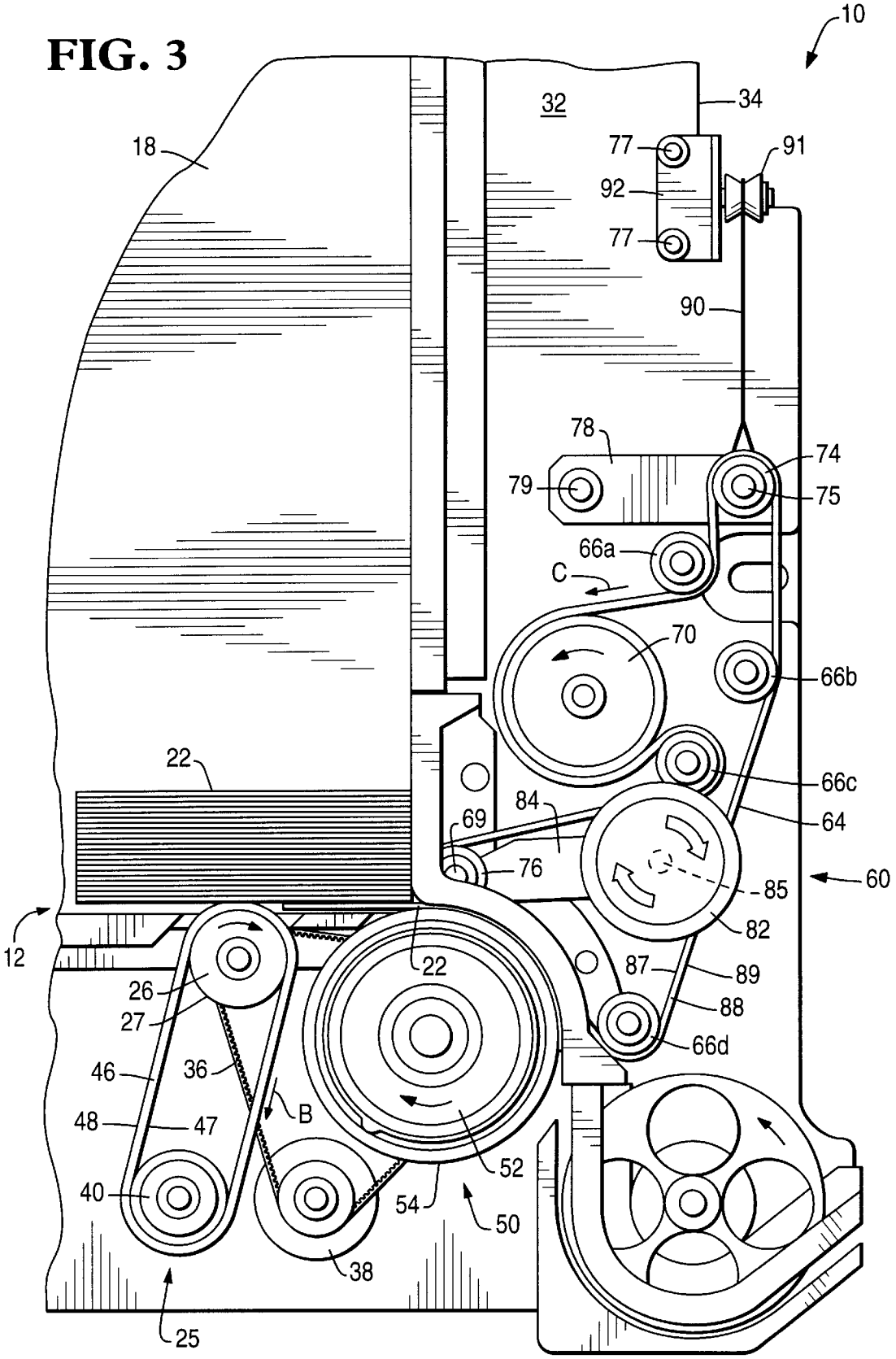
FIGS. 3 and 4 are views similar to FIG. 2 and showing parts in different positions.
Figure 4:
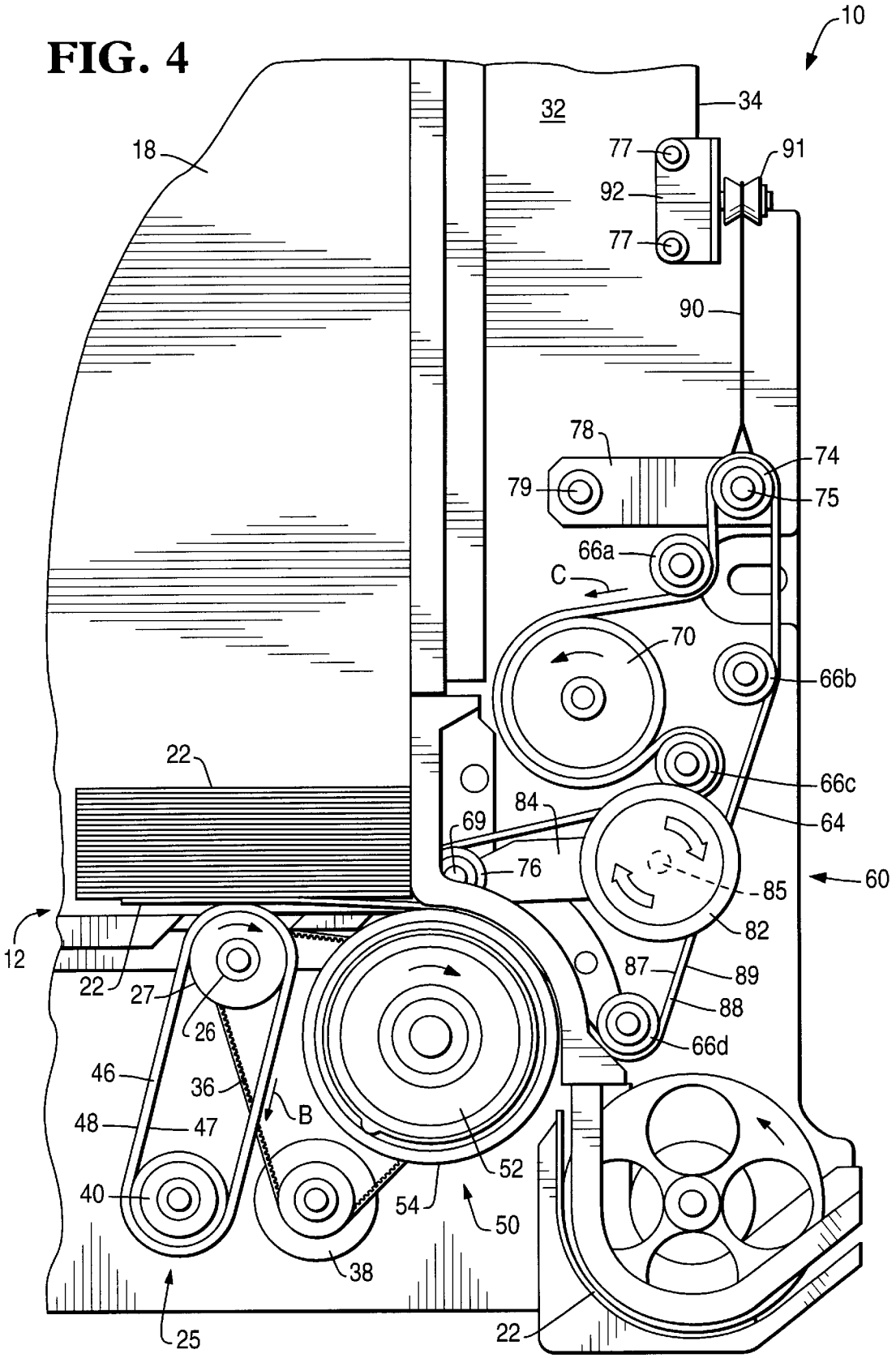

As the bottom document in the stack 22 is being picked, as shown in FIG. 2, the picked document is moved by the picker belt 46 along the document feed path 16 to a position such as shown in FIG. 3. The pinch pressure between the outer circumferential surface 54 of the advance roller 52 and outer endless major side surface 89 of the retard belt 88 in the vicinity of the document feed path 16 is applied to the picked document to continue moving the document along the document feed path. Since the outer circumferential surface 54 of the advance roller 52 in the vicinity of the document feed path 16 is moving at a speed slightly higher than the speed at which the outer endless major side surface 89 of the retard belt 88 in the vicinity of the document feed path 16 is moving, the chance of feeding more than one document into the document feed path 16 (i.e., a double feed condition) is reduced.

In accordance with the present invention, the pinch pressure applied to the document in the document feed path 16 is constantly adjusted. The pinch pressure is constantly adjusted due to a combination of the torque applied to the second pivot arm 84 and the relatively constant tension in the wire cable 90 which is being applied to the first movable roller 74 to maintain a relatively constant tension in the retard belt 88. The tension in the retard belt 88 is maintained relatively constant because of the weight of the member 97 being constantly applied through the wire cable 90 to the first movable roller 74.

Also, in accordance with the present invention, an operator can manually turn the belt tension release knob 82 clockwise (as viewed in FIGS. 5 and 6) to move the second pivot arm 84 and, therefore, the second movable roller 76 from the position shown in FIG. 5 to the position shown in FIG. 6. Movement of the second pivot arm 84 and the second movable roller 76 from the positions shown in FIG. 5 to the positions shown in FIG. 6 releases tension of the retard belt 88 being applied against the outer circumferential surface 54 of the advance roller 52. When tension of the retard belt 88 being applied against the outer circumferential surface 54 of the advance roller 52 is released, the operator can more easily remove documents which may have become jammed along the document feed path 16 between the retard belt 88 and the advance roller 52.

A number of advantages result by providing a document feeder apparatus which feeds documents into a document feed path in accordance with the present invention. One advantage is that the pinch pressure between the advance roller 52 and the retard belt 88 is independent of normal wear and tear of the outer circumferential surface 54 of the advance roller 52 and the outer endless major side surface 89 of the retard belt 88. Accordingly, the advance mechanism 50 and the retard mechanism 60 self adjust to accommodate normal wear and tear of the outer circumferential surface 54 of the advance roller 52 and the outer endless major side surface 89 of the retard belt 88. The advance mechanism 50 and the retard mechanism 60 also self adjust to the thickness of documents entering the document feed path 16.

Another advantage is that since the amount of surface area of the outer endless major side surface 89 of the retard belt 88 is substantially greater than the amount of surface area of the outer circumferential surface 54 of the advance roller 52, it is expected that only the advance roller 52 will require periodic replacement. Still another advantage is that the retard belt 88 can be easily moved away from the advance roller 52 to allow a jammed document in the document feed path 16 to be easily removed using the release knob 82. Yet another advantage is that since the pinch pressure in that portion of the document feed path 16 between the outer circumferential surface 54 of the advance roller 52 and the outer endless major side surface 89 of the retard belt 88 is being adjusted constantly, "peeling" of documents is reduced. When peeling of documents is reduced, a wider range of document types and document weights can be accommodated.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A document feeder apparatus for feeding documents along a document feed path, the document feeder apparatus comprising:

a picker mechanism for picking a number of documents from a stack of documents stored in a hopper and moving the picked documents along the document feed path;

an advance mechanism including an advance roller having a longitudinal central axis and being rotatable about its longitudinal axis, the advance roller having an outer circumferential surface which is engageable with one side of the picked document moving along the document feed path;

a retard mechanism including an endless retard belt having an outer major side surface which is engageable with the opposite side of the picked document moving along the document path, the outer major side surface of the endless retard belt and the outer circumferential surface of the advance roller cooperating to define at least a portion of the document feed path therebetween; and tension means for applying tension force to the endless retard belt such that a relatively constant pinch pressure is applied to the picked document while the picked document is moving along that portion of the document feed path between the outer major side surface of the endless retard belt and the outer circumferential surface of the advance roller, the tension means including (i) a body having weight, (ii) a number of rollers around which the endless retard belt extends, and (iii) means coupling the body and the rollers such that the weight of the body provides tension force which acts on the rollers to maintain the relatively constant pinch pressure which is being applied to the picked document.

2. A document feeder apparatus according to claim 1, wherein the coupling means includes a cable having a first end connected to the body and a second end connected to at least one of the rollers to allow tension force due to weight of the body to act on the at least one roller and thereby to act on the endless retard belt to maintain the relatively constant pinch pressure which is being applied to the picked document.

3. A document feeder apparatus according to claim 2, wherein the body includes a longitudinally extending member having a first end portion which is pivotably connected to a frame part and a second end portion which is connected to the first end of the cable to allow tension force due to weight of the body to act on the at least one roller and thereby to act on the endless retard belt to maintain the relatively constant pinch pressure which is being applied to the picked document.

4. A document feeder apparatus for feeding documents along a document feed path, the document feeder apparatus comprising:

a picker mechanism for picking a number of documents from a stack of documents stored in a hopper and moving the picked documents along the document feed path;

an advance mechanism including an advance roller having a longitudinal central axis and being rotatable about its longitudinal axis, the advance roller having an outer circumferential surface which is engageable with one side of the picked document moving along the document feed path;

a retard mechanism including an endless retard belt and a number of rollers around which the endless retard belt extends, the endless retard belt having an outer major side surface which is engageable with the opposite side of the picked document moving along the document path, the outer major side surface of the endless retard belt and the outer circumferential surface of the advance roller cooperating to define at least a portion of the document feed path therebetween; and belt tension release means for enabling the endless retard belt in that portion of the document feed path between the outer major side surface of the endless retard belt and the outer circumferential surface of the advance roller to be pivoted away from the advance roller and thereby to allow a jammed document to be more easily removed therefrom, the belt tension release means including a rotatable belt tension release knob coupled to at least one of the rollers of the retard mechanism such that the endless retard belt in that portion of the document feed path between the outer major side surface of the endless retard belt and the outer circumferential surface of the advance roller move away from the advance roller body when the belt tension knob is rotated in a predetermined direction.

5. A document feeder apparatus for feeding documents along a document feed path, the document feeder apparatus comprising:

a picker mechanism for picking a number of documents from a stack of documents stored in a hopper and moving the picked documents along the document feed path, the picker mechanism including a picker roller and an endless picker belt disposed around at least a portion of the picker roller, the picker belt having an outer surface which engages the documents in the stack of documents as the picker belt moves relative to the documents;

an advance mechanism including an advance roller having a longitudinal central axis and being rotatable about its longitudinal axis, the advance roller having an outer circumferential surface which is engageable with one side of the picked document moving along the document feed path;

a retard mechanism including an endless retard belt having an outer major side surface which is engageable with the opposite side of the picked document moving along the document path, the outer major side surface of the endless retard belt and the outer circumferential surface of the advance roller cooperating to define at least a portion of the document feed path therebetween; and belt tension release means for enabling the endless retard belt in that portion of the document feed path between the outer major side surface of the endless retard belt and the outer circumferential surface of the advance roller to be pivoted away from the advance roller and thereby to allow a jammed document to be more easily removed therefrom.

* * * * *